US009167357B2

(12) United States Patent
Fischer

(10) Patent No.: US 9,167,357 B2
(45) Date of Patent: Oct. 20, 2015

(54) METHOD FOR THE BINAURAL LEFT-RIGHT LOCALIZATION FOR HEARING INSTRUMENTS

(75) Inventor: Eghart Fischer, Schwabach (DE)

(73) Assignee: Sivantos Pte. Ltd., Singapore (SG)

( * ) Notice: Subject to any disclaimer, the term of this patent is extended or adjusted under 35 U.S.C. 154(b) by 409 days.

(21) Appl. No.: 13/579,985

(22) PCT Filed: Jul. 7, 2010

(86) PCT No.: PCT/EP2010/059690

§ 371 (c)(1),
(2), (4) Date: Aug. 20, 2012

(87) PCT Pub. No.: WO2011/101043

PCT Pub. Date: Aug. 25, 2011

(65) Prior Publication Data

US 2012/0321091 A1 Dec. 20, 2012

(30) Foreign Application Priority Data

Feb. 19, 2010 (EP) ..... 10154096

(51) Int. Cl.
*H04R 15/00* (2006.01)
*H04R 25/00* (2006.01)

(52) U.S. Cl.
CPC ..... *H04R 25/407* (2013.01); *H04R 25/552* (2013.01); *H04R 2225/43* (2013.01); *H04R 2410/01* (2013.01); *H04R 2430/21* (2013.01)

(58) Field of Classification Search
CPC ..... H04R 2225/43; H04R 2410/01; H04R 2430/21; H04R 25/407; H04R 25/552
USPC ..... 381/23.1, 71.1–71.8, 94.1–94.4, 104, 381/92, 91, 355, 356, 369, 312, 320, 120, 381/122, 94.7; 704/225, 226
See application file for complete search history.

(56) References Cited

U.S. PATENT DOCUMENTS 6,778,674 B1 8/2004 Panasik et al.
2003/0147538 A1 * 8/2003 Elko ..... 381/92

(Continued)

FOREIGN PATENT DOCUMENTS

CN 1832636 A 9/2006
CN 102783184 A 11/2012

(Continued)

OTHER PUBLICATIONS

Junfeng Li et al.: "Two-Stage Binaural Speech Enhancement With Wiener Filter Based on Equalization-Cancellation Model", Applications of Signal Processing to Audio and Acoustics, 2009, WASPAA 2009. IEEE Workshop on, IEEE, Piscataway, NJ, USA, Oct. 18, 2009, pp. 133-136, XP031575098, p. 134-135, Figure 1, ISBN: 978-1-4244-3678-1.

(Continued)

*Primary Examiner* — Lun-See Lao
(74) *Attorney, Agent, or Firm* — Laurence A. Greenberg; Werner H. Stemer; Ralph E. Locher

(57) ABSTRACT

A method and system for improving signal-to-noise ratio of output signals of a microphone system having two or more microphones due to acoustic useful signals occurring at sides of the system, is used in hearing instruments, especially hearing aids worn on the head. High and low frequency portions (cut-off frequency between 700 Hz and 1.5 kHz, approx. 1 kHz) are processed differently. In low frequency ranges, differential microphone signals directed towards left and right are produced to determine lateral useful and noise sound levels using two directional signals. These levels are used for individual Wiener filtering for every microphone signal. The natural head shadowing effect is used in high frequency ranges as a pre-filter for noise and useful sound estimation for subsequent Wiener filtering. The methods are used in hearing instruments worn on the head individually for high or for low frequencies and in combination complement each other.

20 Claims, 4 Drawing Sheets

(56) References Cited

U.S. PATENT DOCUMENTS

| | | | | |
|---|---|---|---|---|
| 2004/0196994 | A1* | 10/2004 | Kates | 381/320 |
| 2009/0238385 | A1* | 9/2009 | Fischer | 381/312 |
| 2010/0280825 | A1* | 11/2010 | Takano et al. | 704/225 |
| 2011/0069851 | A1 | 3/2011 | Kjems et al. | |
| 2012/0128164 | A1 | 5/2012 | Blamey | |
| 2012/0321092 | A1 | 12/2012 | Fischer | |

FOREIGN PATENT DOCUMENTS

| | | | |
|---|---|---|---|
| EP | 1465456 | A2 | 10/2004 |
| EP | 2104377 | A2 | 9/2009 |
| WO | 2010022456 | A1 | 3/2010 |

OTHER PUBLICATIONS

Microphone Arrays / Binaural Noise Supression, James M. Kates: "Digital Hearing Aids", Jan. 1, 2008, Plural Publishing, San Diego, XP002632569, p. 136-143, Figure 5-16, p. 416-425, Figure 13-9, ISBN: 978-1-59756-317-8.

* cited by examiner

METHOD FOR THE BINAURAL LEFT-RIGHT LOCALIZATION FOR HEARING INSTRUMENTS

BACKGROUND OF THE INVENTION

Field of the Invention

The invention relates to a method and a system for improving the signal-to-noise distance of output signals of a microphone arrangement of two or more microphones due to acoustic useful signals occurring at the sides of the microphone arrangement. Such a method and system can be used in hearing instruments, especially in hearing devices worn on the head of a hearing device user. The term side is to be understood here in particular as to the right and left of the head of the wearer of a binaural hearing device arrangement.

Conventional directional effect methods, which are currently used in hearing devices, offer the option of factoring out signals and/or noises, which strike the hearing device wearer from the front or the rear, from the remaining ambient noises in order thus to increase speech intelligibility. They nevertheless do not provide the option of factoring out signals and/or noises from a lateral source, which strike from the left or right.

Previously known hearing devices only provide the option of highlighting such lateral signals such that the signal of the desired side is transmitted to both ears. To this end, audio signals are transmitted from one side of the ear to the other and are played back there. As a result, a mono signal is nevertheless presented to the hearing device wearer which results in signal properties, which render localization of sound sources possible (binaural cues), getting lost. Such signal properties may be interaural level differences for instance, i.e. the level at the ear and/or hearing device facing the noise and/or signal source is greater than at the ear and/or hearing device facing away therefrom.

Calculation of a conventional, differential directional microphone is not a solution which can be used unrestrictedly, since inter alia with signals with high frequency portions on account of the so-called "spatial aliasing", no differential directional microphone is possible without spatial ambiguities.

Such spatial ambiguities, i.e. the classification of the spatial origin of a signal which is no longer clear, occur if one subtracts a right and left microphone signal of an acoustic source signal from one another. The differential processing by means of subtracting the microphone signals normally allows a targeted sensitivity of the microphone arrangement in a desired direction. If the wavelength of the acoustic source signals is however too small in comparison with the spatial distance of the microphone in the microphone arrangement, the spatial origin of a source signal can still only be determined equivocally.

BRIEF SUMMARY OF THE INVENTION

The object of the invention consists in specifying an improvement in the interference signal-useful signal distance in acoustic signals by taking a spatial direction of the signal source into account.

The invention achieves this object in that it is considered to be a classical interference noise reduction problem. A binaural interference signal and a binaural useful signal are determined and/or estimated in the manner described below, said signals being used as input signals of a suitable filter, e.g. a Wiener filter, in which an amplification factor is preferably calculated and applied per frequency band which is equally large for both sides of the ear. The use of the same amplification factor for both ears achieves the interaural level differences, i.e. the localization of sounds and/or sound sources is enabled.

A basic idea behind the invention consists in processing high and low frequency portions (limit frequency in the region between 700 Hz and 1.5 kHz, e.g. approx. 1 kHz) differently. For low frequency ranges, a filtering takes place, preferably similar to a Wiener filtering, on account of a differential preprocessing with the aid of the calculation of a differential binaural directional microphone, wherein a signal directed to the left and to the right is generated by means of the preprocessing, typically with oppositely directed cardioid characteristic (kidney-shaped direction-dependent sensitivity).

These two signals directed to the left and to the right on the basis of a conventional differential directional microphone are used as a basis for estimating the level of lateral useful and interference sound, wherein these estimations are in turn used as input variables for the filtering, preferably Wiener filtering.

This filtering is then applied separately to each of the microphone signals of the microphone arrangement, and not to the shared differential directional microphone signal of the binaural arrangement, which was calculated as an output signal of the conventional directional microphone.

The advantage, e.g. compared with the use of Omni signals, is that the upstream directional effect artificially generates greater differences between the left and right side, which manifest themselves in increased interference sound suppression of signals, which strike from the direction to be suppressed.

An advantageous development provides to perform, as described above, a prefiltering with the aid of the calculation of a conventional differential directional microphone and subsequent filtering, preferably Wiener filtering in low frequency ranges, and to use the natural shadowing effect of the head as a prefilter for interference and useful sound estimation for a subsequent Wiener filtering in high frequency ranges (limit frequency in the range between 700 Hz and 1.5 kHz, e.g. approx 1 kHz).

The determination of interference and useful sound estimation by using the shadowing effect of the head takes place as follows: the monaural signal facing the desired side is used as a useful signal estimation, the side facing away therefore as an interference sound estimation. This is possible since particularly with higher frequencies (>700 Hz and/or >1 kHz) the shadowing effect of the head brings about a considerable attenuation of the signal on the opposite side.

These two signals directed to the left and to the right on the basis of a signal which is prefiltered by shadowing of the head are used as a basis for the estimation of the level of lateral useful and interference sound, and these estimations are in turn used as input variables for the filtering, preferably Wiener filtering.

This filtering is then applied separately to each of the microphone signals of the microphone arrangement.

The advantage, e.g. compared with the use of Omni signals, is that on account of the upstream directional effect, greater differences are artificially generated between the left and right side, which manifest themselves in an increased interference sound suppression of signals, which strike from the direction to be suppressed.

A signal directed to the left and to the right is generated in each instance for the low and/or high frequency range by the respective preprocessing, usually with oppositely directed cardioid characteristic (kidney-shaped direction-dependent sensitivity). These respectively directed signals are used as a basis for the estimation of respective lateral useful and interference sound levels. The respective useful and interference sound levels are in turn used as input variables for the filtering, preferably Wiener filtering. By combining the respective filtering method for high and for low frequency ranges, a filtering can therefore be achieved above the entire frequency range.

In a further advantageous development, the acoustic signals are broken down into frequency bands, and the filtering, preferably Wiener filtering, is performed specifically for each of the frequency bands.

In a further advantageous development, the filtering, preferably Wiener filtering, is performed in a directionally-dependent manner. The direction-dependent filtering can be performed in a conventional manner.

One or several of the following parameter values is advantageously determined and/or estimated as a useful signal level and/or as an interference signal level: energy, output, amplitude, smoothed amplitude, averaged amplitude, level.

BRIEF DESCRIPTION OF THE SEVERAL VIEWS OF THE DRAWING

Further advantageous developments and advantages are to be taken from the dependent claims and the subsequent figures plus the description, in which:

DESCRIPTION OF THE INVENTION

Figure 1:
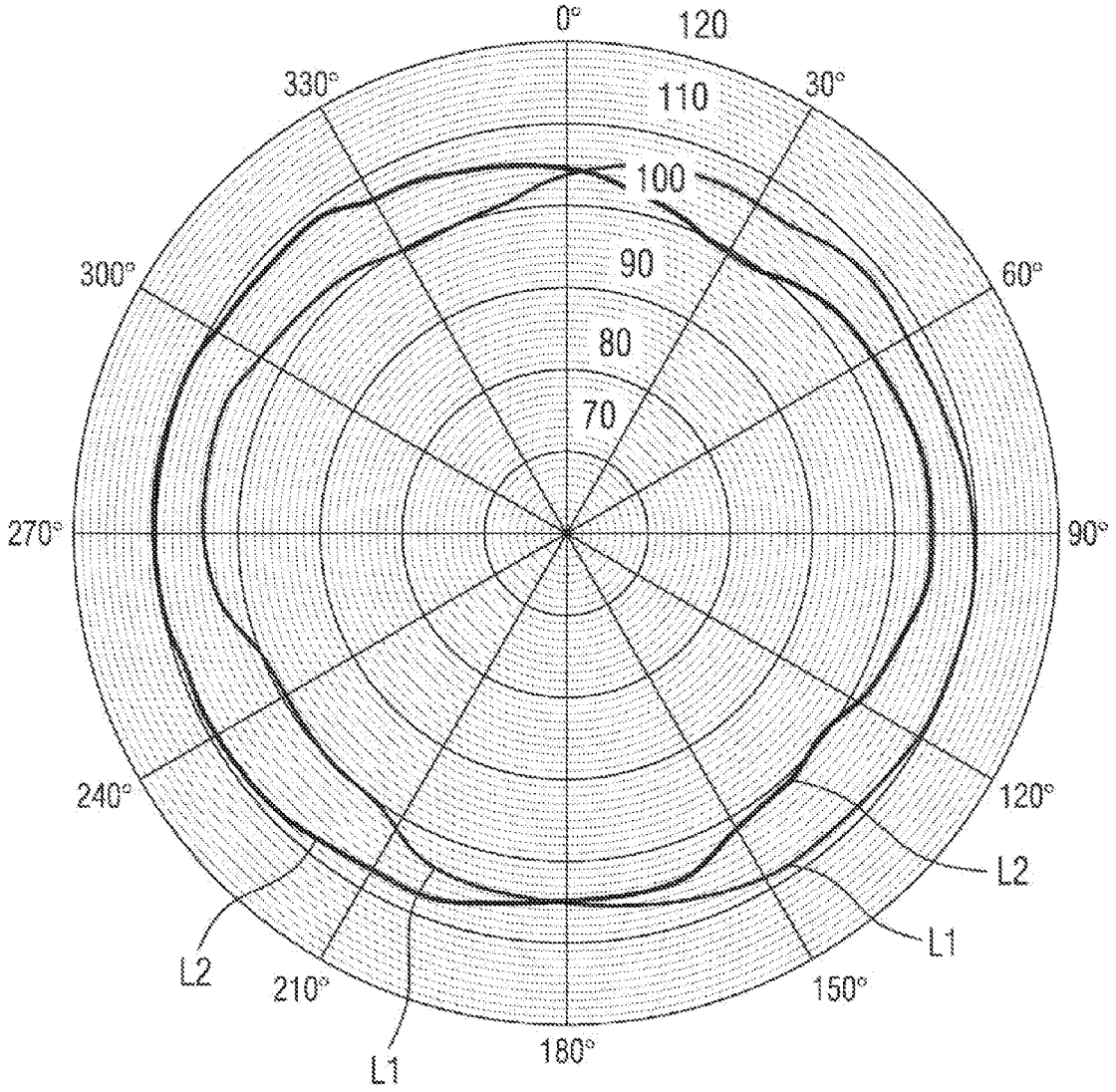
FIG. 1: shows a level of the left and right microphone for a circumferential signal at 1 kHz

FIG. 1 shows the level of the hearing device microphone and/or microphone arrangements on the left (provided with reference character L2 in figure) and right (reference character L1) side of the ear of a binaural hearing device arrangement for a circumferential signal, i.e. for a signal source positioned in the circumferential spatial directions shown, at 1 kHz. A difference of 6-10 dB is apparent, i.e. the level L2 of the left microphone and/or microphone arrangement is higher by 6-10 dB for a left signal (270°) than the level L1 of the right microphone and/or microphone arrangement; this level difference increases further with higher frequencies.

If hearing to the left (270°) is now required for instance, the right signal L1 is used as an interference sound signal, the left L2 as a useful sound signal. On the basis of this interference sound and useful sound signal, the input variables can then be estimated for a filtering, e.g. Wiener filtering.

Respective useful signal and interference signal levels are determined and/or estimated from the useful signal and the interference signal for the Wiener filtering. These were used as input variables for a Wiener filtering, in other words:

Wiener filter=useful signal level/(useful signal level+ interference signal level)

Figure 2:
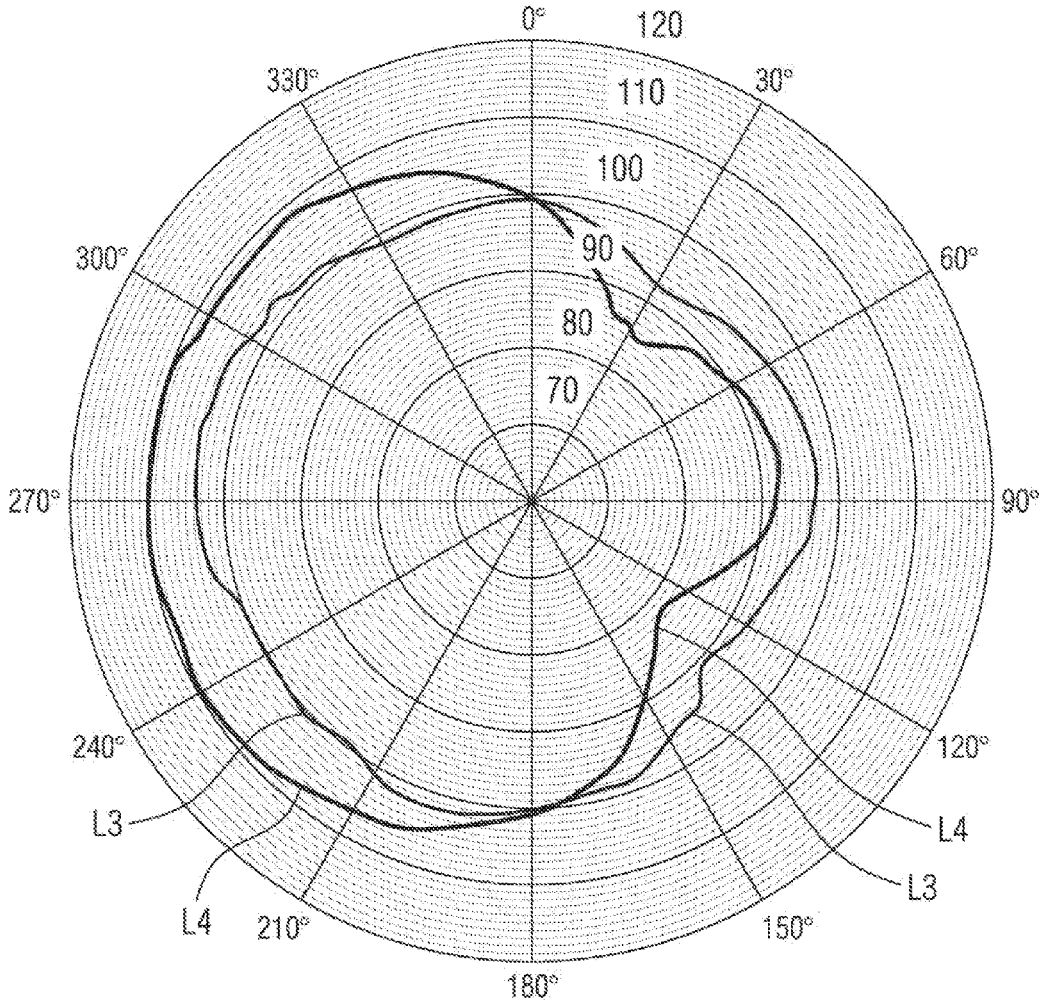
FIG. 2: shows a direction-dependent attenuated signal at 1 kHz after applying a Wiener filter for the left side and right side microphone

FIG. 2 shows the directional-dependent attenuation, which results at 1 kHz when using the Wiener formula for a circumferential (360°) signal. The direction-dependent attenuated signal L4 results for the left microphone and/or microphone arrangement and L3 for the right microphone and/or microphone arrangement.

Compared with the preceding figure, it is apparent that the interaural level differences are retained. Signals from the right side are observed as interference signals and lowered, signals from the left remain unattenuated. The spatial impression, i.e. the signal information from where the signals come in each instance is retained, since the level differences are retained. If signals enter from both sides, there is a drop in the ratio of useful sound and interference sound estimation according to the known Wiener formula.

As previously described, it is proposed to make use of the natural shadowing effect of the head in order to use the signals prefiltered by the shadowing effect of the head as interference and useful signals for determining the input variables of an interference noise elimination approach which is based on a filter, e.g. Wiener filter. Since the shadowing effect of the head is particularly obvious at high frequencies (>700 Hz and/or >1 kHz), but is however reduced further at lower frequencies, this method can be used particularly advantageously for frequencies above 1 kHz.

For low frequencies (<1.5 kHz and/or <1 kHz), the solution explained above cannot be used optimally on account of the shadowing effect of the head. In low frequency ranges, the method described below can be used again, which can also be used separately and exclusively.

Since for low frequencies (<1.5 or <1 kHz), the binaural microphone distance on the head of a hearing device wearer is small enough compared with the wavelength, no spatial ambiguities occur (spatial aliasing). Therefore a conventional differential directional microphone, which "looks" and/or "listens" to the side, can be calculated at low frequencies (<1.5 kHz and/or <1 kHz) of the acoustic source signal with the microphone arrangement of a left and a right microphone and/or microphone arrangement on the head of a hearing device wearer.

The output signal of such a directional microphone could be easily used directly, in order to generate a lateral directional effect at low frequencies. The directed signal determined in this way could then be reproduced identically on both ears and/or hearing devices of the hearing device wearer. This would nevertheless result in the localization ability in this frequency range getting lost, since only a shared output signal would be generated and displayed for both sides of the ear.

Instead, both a signal directed to the left and also to the right is therefore calculated on the basis of a conventional directional microphone and these signals are used according to the desired useful signal direction as interference and/or useful sound signal for a subsequent filtering, preferably with Wiener filter. This filter is then applied separately to each of the microphone signals of the microphone arrangement, and not however to the shared directional microphone signal calculated as an output signal of the conventional directional microphone.

Figure 3:
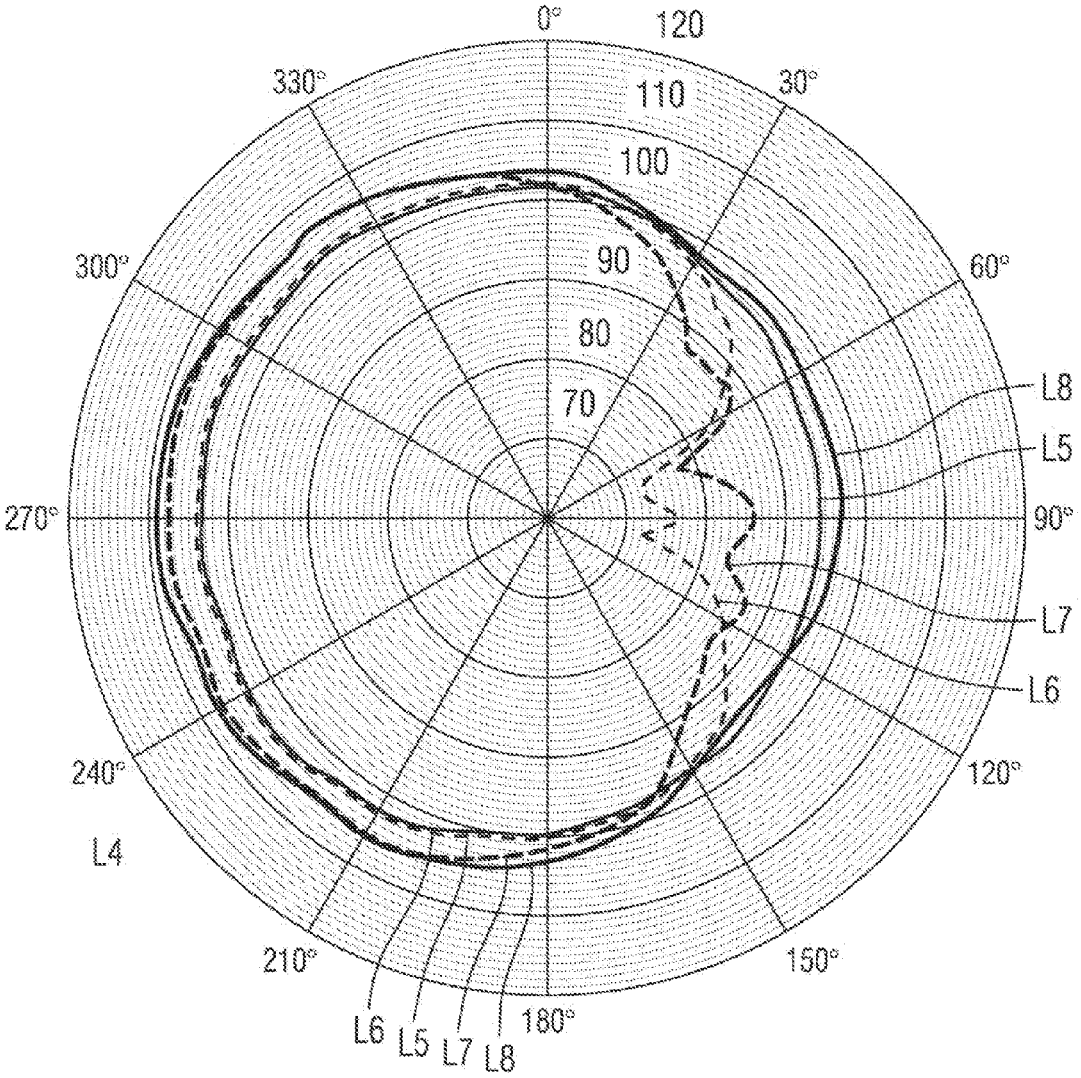
FIG. 3: shows the targeted differential directional microphone signal and respective Wiener pre-filtered microphone signal for frequencies of 250 Hz and 500 Hz to the left (at 270°)

FIG. 3 shows the effect of the previously explained hearing signal processing in low frequency ranges. For this, a left-directed "hearing" or "seeing" on the left (at 270°) has been calculated for frequencies of 250 Hz L8 and 500 Hz L5.

Within the scope of the prefiltering, a conventional differential directional microphone which is directed to the left is initially calculated as a useful signal and as an interference signal directed to the right (continuous line in the Figure). The directed microphone signals have the usual kidney/anti-kidney shaped (cardioid/anticardioid, briefly also card/anticard) direction-dependent sensitivity characteristic.

Useful signal and interference signal levels are determined and/or estimated from the useful signal and interference signal. This was used as an input variable for a Wiener filter, in other words:

Wiener filter=useful signal level/(useful signal level+interference signal level).

Such a Wiener filter was calculated for each frequency range (in Figure therefore 250 Hz and 500 Hz) for all spatial directions and applied individually to each of the directional microphone signals. As a result, a Wiener pre-filtered direction-dependent sensitivity characteristic, shown in Figure by dashed lines L6 and L7, results for each of the directional microphone signals.

The figure shows how a higher attenuation is achieved in the interference signal direction (in other words right, 90°) than in the useful signal direction (in other words left 270°). It is also apparent that the level differences are largely retained (namely a higher level of the left L7 compared with the right microphone signal L6) and thus a spatial assignment of the acoustic source signal largely remains possible for the hearing device wearer.

The previously described filter methods for high and low frequency ranges can be used individually for high or for low frequencies in hearing instruments to be worn on the head for instance. They can however also be used in combination and in this process particularly advantageously extend beyond the entire frequency range of a hearing instrument to be worn on the head.

Figure 4:
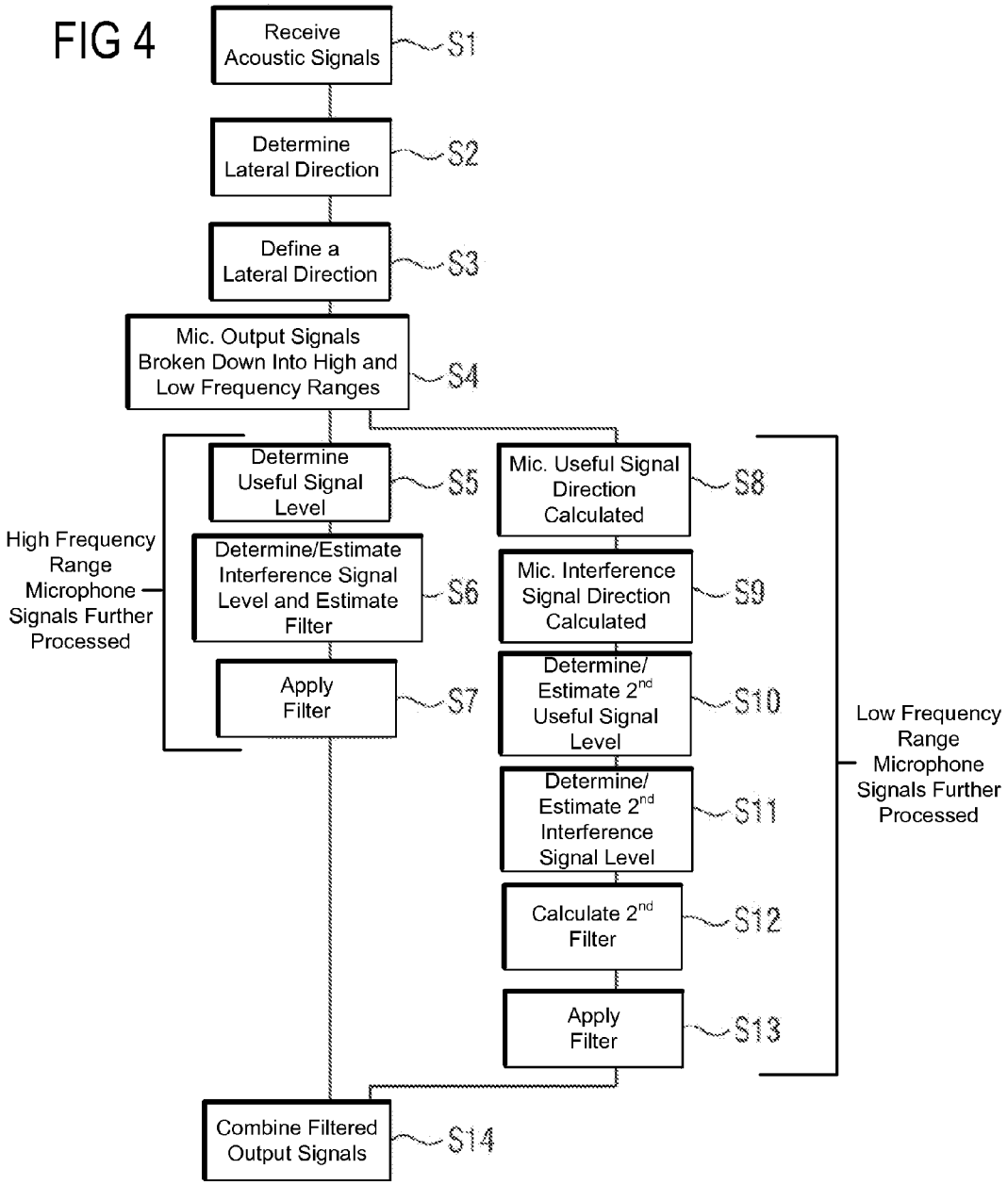
FIG. 4: shows a schematic representation of the method for improving the signal-to-noise distance with a binaural left-right localization.

FIG. 4 shows a schematic representation of the method described above for improving the signal-to-noise distance in binaural left-right localization.

In step S1, a binaural microphone arrangement receives acoustic signals. Such a microphone arrangement includes at least two microphones, to be worn to the left or right on the head of a hearing device wearer respectively. The respective microphone arrangement may also include several microphones respectively, which can enable a directional effect for localization toward the front and/or rear for instance.

In step S2, a lateral direction is determined, at which the highest sensitivity of the microphone arrangement is to be directed. The direction can be automatically determined as a function of an acoustic analysis of the ambient noises or as a function of a user input. The spatial direction in which the source of the acoustic useful signal lies or presumably lies, is selected as the direction with the highest sensitivity. It is therefore also referred to as useful signal direction. The microphone and/or microphone arrangement disposed in this direction is similarly also currently referred to as useful signal microphone.

In step S3, a lateral direction is defined, in a similar manner to the step mentioned above, in which the lowest sensitivity of the microphone arrangement is to be directed. It is therefore also referred to as interference signal direction and the microphone or microphone arrangement disposed in this direction as an interference signal microphone.

The output signals of the microphone are broken down in step S4 into a frequency range having higher frequencies above a limit frequency of at least 700 Hz, possible also 1 kHz, and a frequency range with low frequencies below a limit frequency of 1.5 kHz, possibly also 1 kHz.

The microphone signals in the high frequency range are further processed in steps S5 to S7. In step S5, a useful signal level is determined and/or estimated as a function of the output signal of the useful signal microphone.

An interference signal level is determined and/or estimated in step S6 as a function of the output signal of the interference signal microphone.

In step S6, a filter, preferably a Wiener filter, is calculated using the useful signal level and interference signal level determined above. The signal level and the filtering can be determined for the complete high frequency range. Nevertheless, a breakdown into frequency bands can take place within the high frequency range, and the filtering can take place individually for each of the frequency bands.

In step S7, the filter calculated previously is applied separately to the respective output signals of the right and left microphone and/or microphone arrangement in the high frequency range.

In steps S8 to S13, the microphone signals of the low frequency range are further processed. In step S8, a conventional differential binaural directional microphone is calculated with high sensitivity in the useful signal direction, as a result of which a second useful signal is obtained.

In step S9, a conventional, differential binaural directional microphone with high sensitivity is calculated in the interference signal direction, as a result of which a second interference signal is obtained.

In step S10, a second useful signal level is determined and/or estimated as a function of the second useful signal.

In step S11, a second interference signal level is determined and/or estimated as a function of the second interference signal.

In step S12, a second filter, preferably Wiener filter, is calculated using the second useful signal level and second interference signal level calculated beforehand. The second signal level and the filtering can be determined for the complete low frequency range. Nevertheless, the frequency bands can be broken down within the low frequency range and the filtering can take place individually for each of the frequency bands.

In step S13, the previously calculated filter is applied separately to the respective output signals of the right and left microphone and/or microphone arrangement in the low frequency range.

In step S14, the filtered output signals of the microphones of both frequency ranges and/or with a further breakdown into frequency ranges of all frequency bands, are combined to form a filtered output signal of the binaural microphone arrangement.

An embodiment variant of the method which is not shown alone in the Figures includes the following detailed steps:

- receiving acoustic useful signals with at least two microphones, wherein one microphone is closer to the source of the acoustic useful signal than the other microphone,
- defining a microphone closer to the source as a useful signal microphone and a microphone further from the source as an interference signal microphone
- defining a relevant frequency range, including frequencies greater than 700 Hz,
- determining an interference signal level in the relevant frequency range as a function of the output signal of the interference signal microphone,
- determining a useful signal level in the relevant frequency range as a function of the output signal of the useful signal microphone and
- determining an amplification factor for the amplification of acoustic signals received with the microphones as a function of the estimated interference signal level and the estimated useful signal level.

In one development, the output signals of the microphone are broken down into frequency bands, and the amplification factor is determined separately in each instance for one or several of the frequency bands.

In a further development, the amplification factor (Wiener) is determined according to the formula amplification factor (Wiener)=useful signal level/(useful signal level+interference signal level).

In a further development, the useful signal microphone is arranged on a hearing device to be worn on the right by a hearing device wearer and the interference signal microphone is arranged on a hearing device to be worn on the left by the hearing device wearer, or vice versa.

In a further development, one or several of the following is estimated as a useful signal level and/or as an interference signal level: energy, output, amplitude, smoothed amplitude, averaged amplitude, level.

A further development also includes the following steps:

receiving acoustic useful signals with a microphone arrangement including at least two microphones, wherein a microphone is closer to the source of the acoustic useful signal than to that of the other microphone, defining a microphone disposed closer to the source as a useful signal microphone and a microphone further from the source as an interference signal microphone, defining a relevant frequency range including frequencies lower than 1.5 kHz, determining an interference signal by differential processing of the output signals of the microphone arrangement, in which a lower sensitivity is achieved in the direction of the microphone arranged closer to the source than in the opposite direction, determining an interference signal level as a function of the interference signal in the relevant frequency range, determining a useful signal by differential processing of the output signals of the microphone arrangement, in which a higher sensitivity of the microphone arrangements achieved in the direction of the microphone arranged closer to the source than in the opposite direction determining a useful signal level as a function of the useful signal in the relevant frequency range, and determining an amplification factor for the amplification of acoustic signals received by the microphones as a function of the interference signal level and the useful signal level, wherein the amplification factor is applied separately to each output signal of the microphone arrangement.

In a further development, the output signals of the microphone are broken down into frequency bands, and the amplification factor is determined in each instance separately for one or several of the frequency bands.

In a further development, the amplification factor (Wiener) is determined according to the formula amplification factor (Wiener)=useful signal level/(useful signal level+interference signal level).

In a further development, the useful signal microphone is arranged on a hearing device to be worn on the right by a hearing device wearer and the interference signal microphone is arranged on a hearing device to be worn on the left and/or vice versa.

In a further development, one or several of the following is estimated as a useful signal level and/or as an interference signal level: energy, output, amplitude, smoothed amplitude, average amplitude, level.

In a further development, an amplification factor is determined in a low frequency range, which includes frequencies of less than 1.5 kHz, as explained in the immediately preceding sections, and an amplification factor is determined in a high frequency range, which includes frequencies of greater than 700 Hz, as specified in the sections introduced in the preceding sections.

The invention can be summarized as follows: the invention relates to a method and a system for improving the signal-to-noise distance in output signals of a microphone arrangement of two or more microphones due to acoustic useful signals occurring at the sides of the microphone system. Such a method and system can be used in hearing instruments, especially in hearing devices worn on the head of a hearing device user. To solve this problem, the invention proposes processing high and low frequency portions (limit frequency in the range between 700 Hz and 1.5 kHz, e.g. approx. 1 kHz). In low frequency ranges, a differential microphone signal directed to the left and to the right is generated in order to determine the level of the lateral useful and interference sound with the aid of these two directional signals. These levels are in turn used for a Wiener filtering and each of the microphone signals is individually subjected to the Wiener filtering. In addition, in high frequency ranges, the natural shadowing effect of the head is used as a prefilter for interference and useful sound estimation for a subsequent Wiener filtering. Each of the microphone signals is then subjected individually to the Wiener filtering. The method can be used for instance in hearing instruments to be worn on the head individually for high or low frequencies, they may however also be used in combination and extend particularly advantageously in this process.

The invention claimed is:

1. A method for improving a signal-to-noise ratio in laterally occurring acoustic useful signals, the method comprising the following steps:

receiving acoustic signals with at least two microphones of a microphone system, one of the microphones being closer to a source of the acoustic signals than the other of the microphones;

defining a spatial direction as a useful signal direction and a spatial direction as a noise signal direction;

determining a noise signal by differential processing of output signals of the microphone system, and achieving a lower sensitivity in the useful signal direction than in the noise signal direction;

determining a useful signal by differential processing of the output signals of the microphone system, and achieving a higher sensitivity of the microphone system in the useful signal direction than in the noise signal direction;

determining a noise signal level in dependence on the noise signal;

determining a useful signal level in dependence on the useful signal; and determining an amplification factor for amplification of acoustic signals received with the microphones in dependence on the noise signal level and the useful signal level.

2. The method according to claim 1, which further comprises:

defining a relevant frequency range including frequencies of less than 1.5 kHz.

3. The method according to claim 1, which further comprises:

defining a relevant frequency range including frequencies of less than 1 kHz.

4. The method according to claim 2, which further comprises:

determining the useful signal level in the relevant frequency range.

5. The method according to claim 3, which further comprises:

determining the useful signal level in the relevant frequency range.

6. The method according to claim 2, which further comprises:

determining the noise signal level in the relevant frequency range.

7. The method according to claim 3, which further comprises:

determining the noise signal level in the relevant frequency range.

8. The method according to claim 1, which further comprises:

defining the microphone disposed closer to the source as a useful signal microphone and defining the microphone disposed further from the source as a noise signal microphone;

determining a second noise signal level in dependence on an output signal of the noise signal microphone;

determining a second useful signal level in dependence on an output signal of the useful signal microphone; and determining an amplification factor for amplification of acoustic signals received with the microphone in dependence on the second noise signal level and the second useful signal level.

9. The method according to claim 8, which further comprises:

defining a second relevant frequency range including frequencies greater than 700 Hz.

10. The method according to claim 8, which further comprises:

defining a second relevant frequency range including frequencies greater than 1 kHz.

11. The method according to claim 9, which further comprises:

determining the second useful signal level in the second relevant frequency range.

12. The method according to claim 10, which further comprises:

determining the second useful signal level in the second relevant frequency range.

13. The method according to claim 9, which further comprises:

determining the second noise signal level in the second relevant frequency range.

14. The method according to claim 10, which further comprises:

determining the second noise signal level in the second relevant frequency range.

15. The method according to claim 1, which further comprises:

applying the amplification factor separately to each output signal of the microphones of the microphone system.

16. The method according to claim 1, which further comprises:

breaking down the output signals of the microphones into frequency bands; and determining the amplification factor separately for at least one respective frequency band.

17. The method according to claim 1, which further comprises:

determining the amplification factor in a directionally-dependent manner.

18. The method according to claim 1, which further comprises determining the amplification factor (Wiener) according to a formula amplification factor (Wiener)=useful signal level/(useful signal level+noise signal level).

19. The method according to claim 1, which further comprises placing one of the useful signal microphone or the noise signal microphone to the right on a hearing device to be worn by a hearing device wearer and placing the other of the useful signal microphone or the noise signal microphone to the left on a hearing device to be worn by the hearing device wearer.

20. The method according to claim 1, which further comprises determining one or more of the following parameter values as at least one of a useful signal level or a noise signal level: energy, output, amplitude, smoothed amplitude, averaged amplitude or level.

* * * * *